United States Patent [19]

Wood

[11] 4,037,007

[45] July 19, 1977

[54] DOCUMENT AUTHENTIFICATION PAPER

[75] Inventor: William Albert Wood, Basingstoke, England

[73] Assignee: Portals Limited, Basingstoke, England

[21] Appl. No.: 600,380

[22] Filed: July 30, 1975

[30] Foreign Application Priority Data

Aug. 2, 1974 United Kingdom ..... 34276/74

[51] Int. Cl.[2] ..... D21H 5/10

[52] U.S. Cl. ..... 428/199; 428/207; 428/211; 428/537; 428/916; 283/8 R; 283/9 R; 8/7; 8/44; 427/7; 162/140

[58] Field of Search ..... 428/199, 916, 306, 307, 428/207, 211; 427/7; 283/8 R, 8 B, 9 R; 8/7, 44; 162/140

[56] References Cited

U.S. PATENT DOCUMENTS

| | | | |
|---|---|---|---|
| 248,198 | 10/1881 | Nesbit | 428/199 |
| 2,309,178 | 1/1943 | Fallon et al. | 427/7 |
| 2,445,586 | 7/1948 | Simons | 427/7 |
| 3,001,887 | 9/1961 | Ahlm et al. | 428/199 |

*Primary Examiner*—Ralph S. Kendall
*Attorney, Agent, or Firm*—Bacon & Thomas

[57] ABSTRACT

Paper for use in the production of security documents incorporates planchettes which have incorporated therein or applied thereto a substance which is capable of taking part in a color-forming reaction. A second substance which is capable of taking part in a different color-forming reaction may be incorporated in other planchettes. When a reagent or reagents is or are applied to the security document to verify the authenticity of the document the substances change color by the color-forming reactions.

Examples of security documents which may be made from such paper are bank cheques, travellers' cheques and other negotiable documents convertible to cash.

15 Claims, No Drawings

DOCUMENT AUTHENTIFICATION PAPER

BACKGROUND OF THE INVENTION

1. FIELD OF THE INVENTION

This invention relates to improvements in or relating to paper for use in the production of security documents.

2. DESCRIPTION OF THE PRIOR ART

Security documents have for many years contained security devices such as watermarks and security threads. Fibres, for example of silk or nylon, or small fragments or planchettes of different colours have been incorporated in paper for security purposes. Invisible or visible fragments of such material have been incorporated, some of which appear visible when viewed with ultra-violet light. Other method of verifying security documents relay on machines which check the documents by optical or magnetic means.

Such methods are, it is to be noted, passive tests involving inspection of the security document by a person or machine. The present invention relates to a security document in which a security device is provided by the presence in and/or on the document of substances capable of taking part in a colour-forming reaction.

Colour-formers have been used for several years in pressure sensitive transfer-copy sets which comprise a transfer sheet and an adsorbent sheet. The transfer sheet has a coating on one surface thereof in contact with the adsorbent sheet. The coating contains a solution of the colour-former retained in the coating by rupturable microcapsules or a rupturable solid film. The adsorbent sheet carries on its surface a co-reactive substance capable of taking part in a colour-forming reaction with the colour-former. On application of localised pressure to the transfer sheet, the rupturing of the microcapsules or film occurs and a solution of the colour-former is released and reacts with the co-reactive substance on the adsorbent sheet with which it is in contact. An image corresponding to the applied pressure is produced on the adsorbent sheet as a result of the colour-forming reaction. Such pressure responsive transfer copy sets are described in U.S. Pat. Spec. Nos. 3,488,207 and 3,244,728.

Colour-formers have also been known for use in typewriter ribbons, such as described in British patent specification No. 664,456. The ribbon, which is generally white, carries a non-evaporable inert liquid containing the colour-former. When used in a typewriter with a paper which has a co-reactive substance on its surface, the colour-former reacts with the coreactive substance and a colour change takes place. The ribbon may contain a number of longitudinal bands each of which contains a colour reactive substance which, when transferred from the ribbon to the surface of a paper having a substance which reacts with the colour reactive substances, will assume a distinctive colour individual to that band.

It is an advantage of the present invention that colour-forming reactions are used in security documents to provide a method of verifying the authenticity of security documents in an active test.

In British patent application No. 18526/74 there is described a security document comprising a substrate, a first substance incorporated in the substrate or applied to the substrate, said first substance being capable of taking part in a colour-forming reaction, and a second substance applied to the substrate, said second substance being capable of taking part in a different colour-forming reaction, whereby, when verification of the security document is effected by the application of at least one reagent to the security document, the said first and second substances change colour by the colour-forming reactions.

In this specification, the term "security documents" includes, for example, negotiable instruments which are convertible to cash on presentation at some stage in their life, e.g. cheques, travellers cheques, Post Office postal orders, lottery tickets, trading checks, bearer bonds and like financial documents; documents which confer valuable rights to the holder, e.g. passports, admission tickets, travel tickets; also are included within this term bank notes.

SUMMARY OF THE INVENTION

According to the present invention there is provided paper for use in the production of security documents by printing thereon, which paper incorporates planchettes, said planchettes having incorporated therein or applied thereto a substance which is capable of taking part in a colour-forming reaction whereby, when a security document produced from said paper is verified by the application of a reagent or reagents, the said substance changes colour by the colour-forming reaction.

The planchettes having the substance associated therewith may be added in normal conventional methods to the paper making stock before the sheet is actually formed. Planchettes of various colours are well known in the production of security papers, although in the past planchettes have been used which were not capable of changing colour by a colour-forming reaction as is the case with the planchettes used in accordance with this invention.

Planchettes to be satisfactorily incorporated into paper must be of a lower substance or basis weight than the required final sheet. The substance or basis weight is conveniently measured in grammes per square meter and planchettes in accordance with this invention are desirably of 10 to 50%, preferably 10 to 35% of the weight in grammes per square meter of the final sheet, and more preferably will be within the range 20 to 35%. Preferably the planchette paper is from 15 to 50 grammes per square meter. The final sheet of security paper generally has a substance or basis weight of 50 to 140 grammes per square meter, preferably from 75 to 100 grammes per square metre. A specific example that has been worked satisfactorily involves the use of planchettes of 28 grammes per square metre incorporated in a paper of 96 grammes per square meter basis weight, for example, a paper typically used for bank cheques.

The planchettes may be any shape, e.g. circular, and the concentration of the planchettes may be varied in different regions of the paper; for example, the planchettes may be concentrated in a relatively narrow strip running through the paper. The concentration of planchettes in the paper as a whole may also be varied.

The planchettes also may be made up of a mixture of planchettes having a first substance which is capable of taking part in a colour-forming reaction incorporated therein or applied thereto and other planchettes having a second substance which is capable of taking part in a different colour-forming reaction whereby when verification of the security document is effected by the application of a reagent or reagents, the said first and second substances change colour by the colour-forming reactions. For example, one type of planchette may be converted to a red and another may be converted to blue.

The paper may also comprise conventional planchettes as well as planchettes of the present invention.

The paper itself may additionally comprise one or more substances capable of taking part in a colour-forming reaction, said substances not being incorporated in planchettes. For example a coating containing said substance may be applied to paper of the invention already containing the planchettes.

The present invention also includes a security document produced by printing on paper as described above. The printed material on the paper may also include one or more substances which are capable of taking part in a colour-forming reaction. The present invention also includes a method of verifying a security document which method comprises the application of a reagent or reagents to the document to effect a colour forming reaction so that each of said substances capable of taking part in a colour forming reaction changes colour.

The paper is accordance with this invention for use in the preparation of security documents may be a paper or a board, and as indicated above, may be made from natural or synthetic materials. Also the paper may be in the form of a paper strip which is adhered to a continuous sheet of plastics material and which may be used as an identity document e.g. a bank credit card.

Those skilled in the art will readily appreciate that the planchettes which are an essential feature of this invention may be produced in many ways.

It will be understood that the planchettes used in the present invention should not contain ingredients which interfere with the colour-forming reaction, neither should the paper into which the planchettes are incorporated.

The first substance may comprise one or more colour-formers and may also contain in either case one or more coloured substances e.g. a pigment or dyestuff which do not change colour or verification of the document. Such coloured substances may be incorporated to provide a wide range of colour changes.

The said first substance may be incorporated throughout a paper substrate, said paper substrate being used subsequently to produce planchettes therefrom, by passing the substrate through a solution of dispersion of the said substance for example by a size press; or the substance may be printed on the whole or a part of one or both surfaces of the substrate; other coating or impregnation processes may be used, for example, one involving the well-known "nip" roller principle, or blade coating or air-knife coating.

The first substance may also be incorporated at the time of formation of the paper for producing planchettes, for example by addition to a paper stock.

The coloured substances may be incorporated separately at the time of formation of the substrate and the colour-former or colour-formers incorporated or applied to the substrate as described above. Alternatively the colour-former or colour-formers may be incorporated during formation of the substrate and the coloured substances incorporated or applied to the substrate as described above.

Generally, the ingredients of the first substance may be added separately or in any combination during formation of the substrate or incorporated in or applied to the substrate as described above.

In one embodiment of the invention the first and second substances may comprise the same colour-former or colour-formers which take part in the same chemical reaction when the reagent or reagents are applied to the security document. Different colour changes may be observed since the first and second substances may comprise different coloured substances, e.g. dyes and/or pigments. Alternatively the colour-former or colour-formers may be present in different concentrations in the first and second substances so that the same chemical reaction takes place between the folour-formers and the reagent or reagents but different colour changes are observed due to the different intensities produced.

The security document may have one or more regions of the planchettes incorporated in the paper. One or more coatings or print applications of a substance capable of taking part in a colour-forming reaction may also be applied. The second substance may comprise any of the constituents or combinations of constituents as the first substance as described above. The coatings or print applications may be in different designs.

It may be necessary to apply separately more than one reagent in order to bring about the changes required on verification. In some cases one reagent will effect two or more colour changes, and also in other cases one application of a mixture of reagents will produce the required effect.

It is preferred that the reagent or reagents is colourless and it is further preferred that one externally applied, colourless reagent is used to activate all the colour changes on and/or in the document.

The colourless reagent or reagents may be applied to the security document by any suitable means. Particular examples of means for bringing the reagent (s) into contact with the security document are a stamp and stamp pad, a felt pen, a roller device through which the security document is fed, a roller or brush for applying the reagent directly to the document or a self-inking stamp, for example, a stamp incorporating a reservoir of the reagent and a capillary for feeding the reagent from the reservoir to the working face of the stamp.

A security document comprising paper according to this invention has the property of being verified, that is its authenticity tested, when the document is presented when the bearer applied for the benefits accruing to that document by the simple application of the necessary reagent or reagents to bring about the required colour change or changes.

The security document comprising paper of the present invention has the advantage that it is very difficult for a potential counterfeiter to discover the nature of the first and second substances incorporated in the planchettes and also which reagent or reagents are required to bring about the required colour changes.

The invention may be used in addition to or combined with other security features which are incorporated in the substrate and/or which are applied to the substrate. In the substrate such security features are for example watermarks, security threads, fibres, conventional planchettes and the like. On the substrate such security features include the print design e.g. rainbow tinting and ink types e.g. fugitive inks.

In the realm of colour chemistry, many substances are known to those skilled in that art which have the property of changing colour when brought into contact with a reagent, for example, a disazo dye. The substance may initially be colourless, but more usually will change from one colour to another during the colour-forming reaction with an appropriate reagent. It will be appreciated that the substances which take part in the colour-forming reactions must be present on one surface of the substrate so that when the final colours are developed a different coloured image is obtained from that present in the original document, the colour difference involving at least two colour changes.

British patent application No. 2928/75 (in the name of Ciba-Geigy A.G.) describes a composition for incorporating into a mass of paper or for completely or partially coating paper, the composition comprising a dispersion of a colour-former in a mixture of water and a water-miscible organic solvent for the colour-foremr.

British patent application No. 18199/74 (in the name of Ciba-Geigy) A.G.) relates to an ink which comprises a neutral or substantially neutral ink vehicle, a non-volatile liquid organic base and a colour-former. The ink is used for printing on to selected areas of a substrate and when contacted with an acid, the printing changes colour because of the activation of the colour-former.

The colour-formers described in British patent applications Nos. 2928/75 and 18199/74 are suitable for use in the present invention as constituents of the first and second substances which are incorporated in or applied to the planchettes of the security document.

The organic solvent for the composition for incorporating into a mass of paper for producing planchettes as described above should be one which will dissolve the selected colour-former and be miscible with water. Suitable solvents include ketones, e.g. acetone; alkoxyethanols, e.g. methoxy ethanol and ethoxyethanol; dimethyl formamide and dimethyl sulphoxide. However, it is preferably non-flammable or has a relatively high flash point and preferably non-toxic. It is also preferred to use a fairly low boiling solvent, for example on having a boiling point below 150° C.

The amount of colour-former in the dispersion varies according to the particular colour-former used and on the desired effect, i.e. whether a dark colour is required or not. In general, the amount used may be from 0.001% to 2%, preferably 0.01% to 1% and more preferably 0.1% to 0.5% by weight, e.g. 0.2%.

The paper from which the planchettes are formed can be coated by any suitable means, such as a size press, roller coating, air-knife coating, blade coating, brush coating or printing.

When the dispersion is used for treating paper pulp in a beater it is advantageous to add the solution of colour-former in organic solvent directly into the bearer which already contains a considerable amount of water thereby forming the dispersion in situ.

The paper used must be either neutral or alkaline sized to prevent the colour-former from reacting prematurely with the paper. The pH of the paper used should be not below 6.5 and this can be achieved, for example, by sizing with aluminium sulphate, rosin size and sodium aluminate to produce a neutral size, or with a ketone dimer to produce an alkaline sized paper.

A colour change will be produced when the treated paper or planchettes cut therefrom is contacted with a colour-former activating substances and such activating substances may be used in the present invention as the reagent or reagents which take part in a colour-forming reaction with the appropriate constituents of the first and second substances in and/or on the planchettes of the security document.

Suitable activating substances or reagents are organic acids, such as maleic acid, oxalic acid, malonic acid, succinic acid, glutaric acid, adipic acid, tricarballylic acid, diglycollic acid, lactic acid, malic acid, tartaric acid, citric acid, pyrophosphonic acid, benzene sulphonic acid, naphthalene-2-sulphonic acid, 1-phenol-4-sulphonic acid, polymaleic acid, co- and ter-polymers of maleic acid with ethyl acrylate and vinyl acetate, hydroxyethane diphosphonic acid, methylamino-N- N-dimethylene phosphonic acid, and those known by the Trade Marks, Dequest 2000 and Dequest 2010.

When the colour-former is a triazene compound of Formula II is also needs to be contacted with an azo coupling component, which may be in admixture with the activating substance.

Such organic acids are generally dissolved in a weakly volatile high boiling solvent having a boiling point of at least 150° C., preferably at least 300° C. Suitable solvents include, for example, partially hydrogenated terphenyl, liquid paraffin, tricresyl phosphate, di-n-butyl phthalate, dioctyl phthalate, trichlorobenzene, glycerol nitrobenzene, trichloroethyl phosphate or water-insoluble hydrocarbon oils, alkyl phthaloyl butyl glycollates, such as propyl-, pentyl-, hexyl- or preferably butyl-phthaloyl butyl glycollate, diethylene glycol, triethylene glycol or polyethylene glycols having a molecular weight of from 200 to 600, e.g. 400, or mixtures thereof.

The amount of organic acid in the solvent is preferably such as to give a saturate solution. Lower amounts may be used, but are less satisfactory. The resulting organic acid solution may have water present, when present the amount of water can be very small.

The dispersion may also contain a dyestuff or pigment of any desired colour. When the dispersion is used to impregnate the paper in a beater, the dyestuff used may be a water-soluble substantive dyestuff or a dispersion of a water-insoluble dye or pigment. When the dispersion is used to coat paper for producing planchettes by one of the techniques described, the dyestuff may be any water-soluble dye or a dispersion of a water-soluble dye or a dispersion of a water-insoluble dye or pigment.

Examples of spirit soluble dyes which may be incorporated in the paper or planchettes are Soluble Yellow D (Ciba-Geigy) and Brilliant Green YNS crystals (I.C.I.).

Suitable water-soluble dyes which may be, for example, applied to the paper at a size press or added to the stock are Pergasol Turquoise Blue RAL, Pergasol Red 3GA Liquid, Pergasol Red 2BA, Pergasol Brilliant Yellow RAL, Paper direct green PD 160 (manufactured by Ciba-Geigy). Examples of pigments which have been applied as components of inks are a thiocyanine blue pigment BCA (manufactured by Ciba-Geigy), a red pigment, 8972 Red 4B and an orange pigment 500 orange (both manufactured by Cory). Planchettes may then be cut in the normal manner from such paper.

Suitable ink vehicles for the ink described in British patent application No. 18199/74 are those which have a pH of about 7. If the pH is not exactly 7 it is preferably slightly above rather than below 7. Examples of such vehicles are nitro-cellulose, zinc resinate, vinyl acrylic polyamide and alkyd resins, ethyl cellulose, stand oils and resin modified stand oils. The liquid organic base may be an amine or an alkanolamine such as triethanolamine or diethanolamine. The ink may contain other conventional ingredients such as an alcohol, e.g. ethanol, propanol or methylated spirits, in amounts up to the amount of ink vehicle, preferably up to about 80% by weight of the ink vehicle, when a liquid ink is required, e.g. a gravure or flexographic ink.

When the ink is printed on to a paper substrate or the like, the colour-former is prevented from producing a colour by the organic base, a colour only being produced when the printing on the paper is treated with an activating substance which counteracts the organic base.

Suitable activating substances are those organic acids described above.

The amount of colour-former in the ink varies according to the particular colour-former used and on the desired effect, i.e. whether a dark colour is required or not. In general the amount used may be from 0.01% to 10%, preferably 0.01% to 5% and more preferably 0.1% to 1% by weight, e.g. 0.5%.

The amount of organic base in the ink may vary over a wide range, but should be sufficient to ensure that no reaction occurs between the colour-former and the substrate on which the ink is printed. The amount may be up to 40% by weight, although amounts of up to 10% are sufficient on most substrates. The amount used is preferably from 0.2% to 6%, more preferably 0.2% to 2%.

British Patent Application No. 18200/74 (in the name of Ciba-Geigy A.G.) describes an image producing system which comprises a carrier material impregnated with a solution of a colour-former in a weakly volatile high boiling solvent and a colour-former de-activating substance, preferably a liquid organic base; and a substrate which has incorporated therein or possesses at least one surface which is at least partially coated with a colour-former activating substance or system and a re-activating substance which counteracts the de-activating substance.

The re-activating substance may be an organic acid as described above.

The first and second substance which are capable of taking part in colour-forming reactions in the present invention may comprise as constituents the colour-formers described in the above mentioned patent applications and known in the art.

The first and second substances, or colour-formers, may be of the lactone type, spyropyran or related compound, a leuco type or metal complex forming type, but are preferably azo compounds having the general Formula I (I)

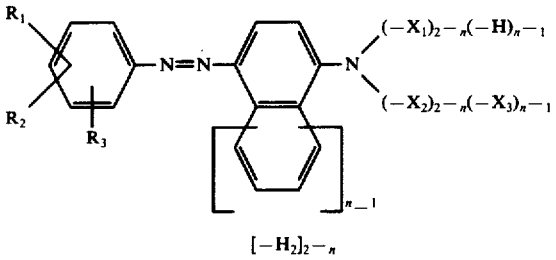

in which $R_1$, $R_2$ and $R_3$ each represents hydrogen, halogen, alkyl, alkoxy, aryloxy, alkoxycarbonyl, dialkylaminocarbonyl, acylamino, acyl(alkyl)amino

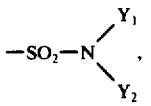

in which $Y_1$ and $Y_2$ each represents alkyl or aryl, or in which $Y_1$ and $Y_2$ together represent an alkylene group; $X_1$ is hydrogen or an alkyl group, $X_2$ is an alkyl, cyanoalkyl or arylmethylene group or $X_1$ and $X_2$ together represent an alkylene group, $X_3$ is an alkyl or aryl group and $n$ is 1 or 2, preferably 1, or the general Formula II:

(II)

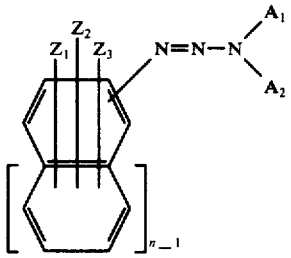

in which $Z_1$, $Z_2$ and $Z_3$ each represents hydrogen, alkyl, substituted alkyl, alkoxy, halogen, nitro, acylamino, aminoacyl or alkoxycarbonyl, $A_1$ and $A_2$ each represents alkyl or phenyl or $A_1$ and $A_2$ together with the nitrogen atom to which they are bound form a heterocyclic ring system and $n$ is 1 or 2.

Various colour changes are possible by using different dyes, pigments and colour-formers. Some of the numerous possible colour changes are as follows:

Yellow→Blue

This can be achieved by the use of a yellow colour-former, which changes colour to blue when activated, either alone or with a yellow dyestuff. Alternatively, a colourless colour-former which turns blue when activated can be used with a yellow dyestuff.

Yellow→Red

As for yellow→blue, except that colour-formers which turn red when activated are used.

Colourless→Blue

A colourless colour former which turns blue when activated.

Colourless→Red

A colourless colour former which turns red when activated.

Blue→Red

Blue dye plus a colourless colour former which turns red when activated.

Red→Blue

Red dye plus a yellow or colourless colour former which turn blue when activated.

Green→Blue

Green dye plus a yellow or colourless colour former which turn blue when activated.

Green→Red

Green dye plus a yellow or colourless colour former which turn red when activated or a blue dye plus a yellow colour former which turns red when activated.

Yellow→Green

Yellow dye plus a colourless colour former which turns green when activated.

Blue→Green

Blue dye plus a colourless colour former which turns green when activated.

Red→Green

Red dye plus a colourless colour former which turns green when activated.

Colour or Colourless→Black

Dye plus a mixture of colour formers which when activated produce colours which, with the dye form black.

It should be noted that where a dyestuff and/or a pigment is present, the final colour is an additive effect of the dyestuff and/or pigment colour and the colour produced by the activated colour-former.

When the colour formers are azo compounds of the formula I, they are preferably those of the general formula III:

(III)

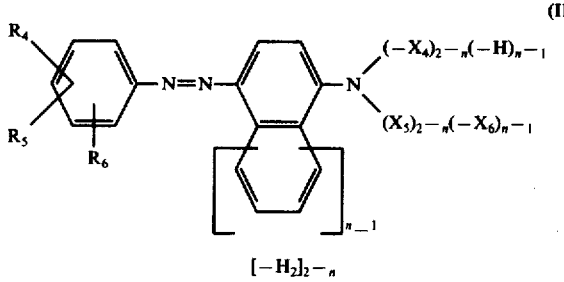

in which $R_4$, $R_5$ and $R_6$ each represent, hydrogen, lower alkyl, lower alkoxy, halogenphenoxy, phenoxy, lower alkoxycarbonyl, lower dialkylaminocarbonyl, acetylamino, halogen, acetyl(lower alkyl)amino,

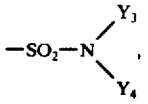

in which $Y_3$ and $Y_4$ each represents lower alkyl or phenyl, or in which $Y_3$ and $Y_4$ together represent an alkylene group with 4 or 5 carbon atoms and, at most two of the radicals $R_4$, $R_5$ and $R_6$ being hydrogen, $X_4$ is hydrogen or lower alkyl, $X_5$ is lower alkyl, lower cyanoalkyl or benzyl, or $X_4$ and $X_5$ together represent an alkylene group with 4 or 5 carbon atoms, $X_6$ is lower alkyl or phenyl and $n$ is 1 or 2.

Of special interest are azo compounds of the formula IV:

(IV)

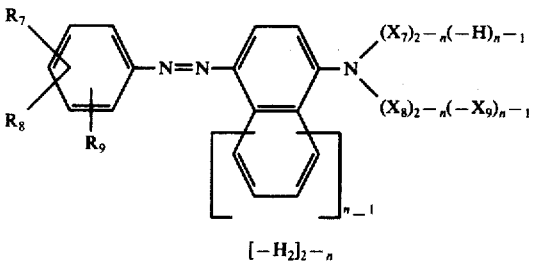

in which $R_7$, $R_8$ and $R_9$ each represents hydrogen, methyl, methoxy, phenoxy, dichlorophenoxy, methoxycarbonyl, dimethylaminocarbonyl, acetylamino, chlorine, acetyl(methyl)amino, -continued

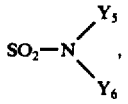

in which $Y_5$ and $Y_6$ each represent methyl, ethyl or phenyl or in which $Y_5$ and $Y_6$ together represent a pentylene group, at most two of the radicals, $R_7$, $R_8$ and $R_9$ being hydrogen, $X_7$ is methyl or ethyl, $X_8$ is methyl, 2-cyanoethyl or benzyl, $X_9$ is methyl or ethyl and $n$ is 1 or 2.

Advantageous results are obtained with colour formers of the formula V:

(V)

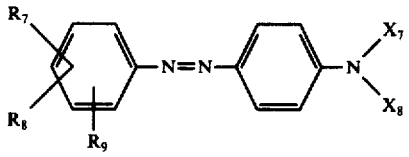

in which $R_7$, $R_8$, $R_9$, $X_7$ and $X_8$ have the meanings given above, and very suitable are colour formers of the formula VI:

(VI)

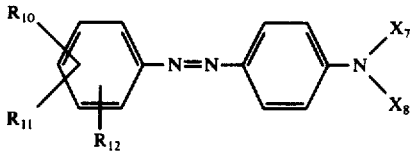

in which $R_{10}$, $R_{11}$ and $R_{12}$ each represents hydrogen, methoxy, methoxycarbonyl chlorine, diethylaminosulfonyl or acetylamino, at most two of the radicals $R_{10}$, $R_{11}$ and $R_{12}$ being hydrogen and $X_7$ and $X_8$ have the meanings given above.

The terms lower alkyl or lower alkoxy in the definitions of radicals of the colour formers means radicals with 1 to 5, especially 1 to 3 carbon atoms, such as methyl, ethyl, propyl, benzyl or amyl or butyl.

When one or more of the R-radicals contain acyl groups, the acyl radical may be derived, for example, from an aliphatic monocarboxylic acid having 1 to 4 carbon atoms such as acetic acid.

When one or more of the R-radicals is halogen it is, e.g. iodine, bromine but preferably chlorine.

When $Y_1$ and $Y_2$ or $Y_3$ and $Y_4$ together represent an alkylene group they form together with the nitrogen atom a heterocyclic ring such as piperidine or pyrrolidine.

Aryl radicals in any of the definitions of the colour formers especially mean naphthalene, diphenyl and preferably benzene radicals.

These colour formers may be prepared by conventional methods known in the art, e.g. by diazotizing a substituted aniline and coupling it onto a N-substituted aniline.

Specific Examples of compounds of general formula I which may be used in the present invention are given in Table I, in which $n$ in formula I is 1 and in Table II in which $n$ in formula I is 2.

Table 1

| No. | R1 | R2 | R3 | X1 | X2 | Absorption max. λmax. free base | Absorption max. λmax. protonated | Colour of* protonated dye |
|---|---|---|---|---|---|---|---|---|
| | Substituents in formula I | | | | | | | |
| 1 | —H | —H | 4-$CH_3CONH$ | —CH3 | —CH3 | 411 | 550 | violet |
| 2 | 2-CH3 | —H | —H | —CH3 | —CH3 | 401 | 506 | orange |
| 3 | —H | 3-CH3 | —H | —CH3 | —CH3 | 406 | 520 | red |
| 4 | —H | —H | 4-CH3 | —CH3 | —CH3 | 404 | 528/542 | red |
| 5 | 2-OCH3 | —H | —H | —CH3 | —CH3 | 413 | 540 | violet |
| 6 | —H | —H | 4-OCH3 | —CH3 | —CH3 | 404 | 556 | violet |
| 7 | 2-OCH3 | —H | 4-OCH3 | —CH3 | —CH3 | 412 | 578 | blue-grey |
| 8 | 2-OCH3 | —H | 5-OCH3 | —CH3 | —CH3 | 425 | 560 | grey |
| 9 | —H | 3-Cl | —H | —CH3 | —CH3 | 416 | 510 | orange |
| 10 | —H | —H | 4-Cl | —CH3 | —CH3 | 415 | 519 | orange |
| 11 | —H | 3-Cl | 4-CH3 | —CH3 | —CH3 | 413 | 510 | orange |
| 12 | 2-CH3 | —H | 4-Cl | —CH3 | —CH3 | 414 | 506 | orange |
| 13 | 2-CH3 | —H | 5-Cl | —CH3 | —CH3 | 418 | 506 | orange |
| 14 | 2-OCH3 | 4-OCH3 | 5-Cl | —CH3 | —CH3 | 420 | 574 | green-grey |
| 15 | 2-$OC_6H5$ | —H | 5-Cl | —CH3 | —CH3 | 430 | 518 | orange |
| 16 | 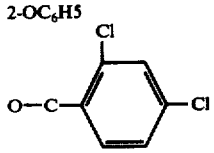 | —H | —H | —CH3 | —CH3 | 418 | 518 | orange |
| 17 | 2-COOCH3 | —H | —H | —CH3 | —CH3 | 417 | 518 | cerise-red |
| 18 | —H | 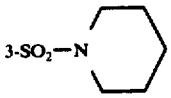 | 4-CH3 | —CH3 | —CH3 | 420 | 514 | orange |
| 19 | —H | 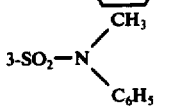 | 4-CH3 | —CH3 | —CH3 | 419 | 517/535 | orange |
| 20 | —H | 3-CH3 | 4-OCH3 | —CH3 | —CH3 | 408 | 542 | brown |
| 21 | —H | —H | 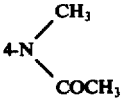 | —CH3 | —CH3 | 418 | 520 | orange |
| 22 | —H | —H | 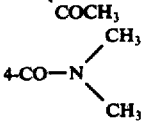 | —CH3 | —CH3 | 421 | 516 | orange |
| 23 | —H | —H | 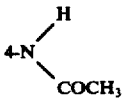 | —CH3 | —$CH_2CH_2CN$ | 405 | 556 | violet |
| 24 | —H | 3-CH3 | —H | —CH3 | —$CH_2CH_2CN$ | 356 | 522/538 | red |
| 25 | —H | —H | 4-CH3 | —CH3 | —$CH_2CH_2CN$ | 396 | 534 | brown |
| 26 | 2-OCH3 | —H | —H | —CH3 | —$CH_2CH_2CN$ | 400 | 542 | brown |
| 27 | 2-OCH3 | —H | 5-OCH3 | —CH3 | —$CH_2CH_2CN$ | 416 | 566 | grey |
| 28 | —H | 3-Cl | —H | —CH3 | —$CH_2CH_2CN$ | 406 | 513/534 | orange |
| 29 | —H | —H | 4-Cl | —CH3 | —$CH_2CH_2CN$ | 404 | 523/541 | orange |
| 30 | —H | 3-Cl | 4-CH3 | —CH3 | —$CH_2CH_2CN$ | 404 | 523/540 | orange |
| 31 | —H | 3-CH3 | —H | —$C_2H5$ | —$CH_2$—$C_6H5$ | 400 | 524/543 | brown-orange |
| 32 | 2-COOCH3 | —H | —H | —$C_2H5$ | —$CH_2$—$C_6H5$ | 418 | 527/542 | red |
| 33 | 2-CH3 | 3-Cl | —H | —CH3 | —CH3 | 413 | 500 | orange |
| 34 | 2-O—$C_6H5$ | —H | 5-t-$C_5H11$ | —CH3 | —CH3 | 416 | 526 | orange |
| 35 | —H | —H | 4-OCH3 | —CH3 | —$CH_2CH_2CN$ | 398 | 555 | brown |
| No. | R1 | R2 | R3 | Y1 | Y2 | free base | protonated | |
| 36 | 2-OCH3 | 4-OCH3 | 5-Cl | —CH3 | —$CH_2CH_2CN$ | 412 | 574 | brown-green |
| 37 | 2-OCH3 | —H | 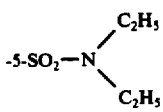 | —CH3 | —CH3 | 427 | 522 | violet |
| No. | R1 | R2 | R3 | X3 | free base | protonated | | |
| 101 | —H | 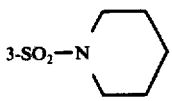 | 4-CH3 | —$C_2H5$ | | | violet | |

Table 1-continued

| Substituents in formula I | | | | | | Absorption max. λmax. in nm | | Colour of* protonated dye |
|---|---|---|---|---|---|---|---|---|
| 102 | —H | $3\text{-}SO_2—N(CH_3)_2$ | 4-CH3 | $—C_2H5$ | | | | violet |
| 103 | 2-CH3 | —H | 4-Cl | $—C_2H5$ | 466 | 540 | | violet |

*Colour here refers to protonation in a solution of 95% acetic acid.

When the colour former is one of general formula II, defined above, alkyl and alkoxy in the definitions of $Z_1$, $Z_2$, $Z_3$, $A_1$ and $A_2$ usually are lower alkyl or alkoxy, which as a rule do not contain more than 4 carbon atoms, e.g. n-butyl, n-butoxy, n-propyl, isopropyl, ethyl, ethoxy, methyl or methoxy. Substituents for alkyl in $Z_1$, $Z_2$ or $Z_3$, e.g. are halogen, hydroxy or lower alkoxy.

The term "halogen" may represent iodine, but preferably bromine or chlorine. The term acylamino preferably means a radical of an aliphatic or aromatic sulfonic or particularly carboxylic acid amide whereby the amide nitrogen may be substituted by lower alkyl. Especially preferrer are radicals of an alkane carboxylic acid amide, where the amide nitrogen optionally is substituted by methyl, such as a formic acid amide, acetic acid amide or propionic acid amide radical or radicals of a benzene carboxylic acid amide such as benzoic acid amide.

The term aminoacyl as a rule stands for an amine substituted —CO— or —$SO_2$— group. The amine radical thereby may be of a primary or secondary aliphatic or an heterocyclic amine. Preferred triazenes correspond to the formula VII.

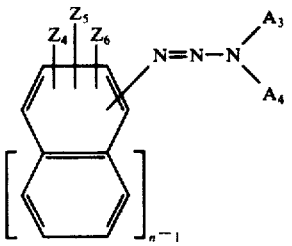

(VII)

in which $Z_4$, $Z_5$ and $Z_6$ each represents hydrogen, alkyl with 1 to 4 carbon atoms, alkoxy with 1 to 4 carbon atoms, halogen, nitro,

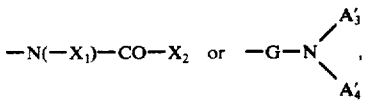

or $COOX_3$, $X_1$ and $X_2$ each representing hydrogen, alkyl with 1 to 4 carbon atoms or phenyl, $X_3$ represents alkyl with 1 to 4 carbon atoms, G is —CO— or —$SO_2$—, $A_3$, $A_4$, $A_3'$ and $A_4'$ each represent alkyl with 1 to 4 carbon atoms or phenyl or $A_3$ and $A_4$, and $A_3'$ and $A_4'$ respectively together with the nitrogen atom to which they are bound from a heterocyclic ring system with one or two rings, each ring containing 5 to 7 ring members and $n$ is 1 or 2.

Of special interest are triazenes of the formula VIII:

-continued

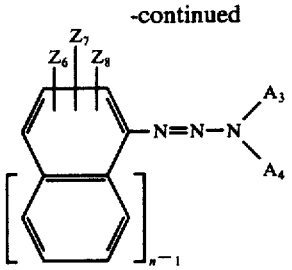

(VIII)

in which $Z_7$ and $Z_8$ each represent hydrogen, alkyl with 1 to 4 carbon atoms, alkoxy with 1 to 4 carbon atoms or halogen, and $Z_6$, $A_3$, $A_4$ and $n$ have the meaning given above.

Advantageous results are obtained with colour formers of the formula IX:

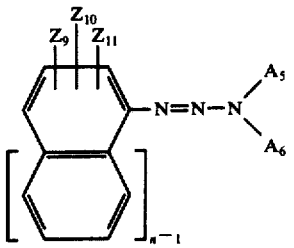

(IX)

in which $Z_9$ represents hydrogen, alkyl with 1 or 2 carbon atoms, alkoxy with 1 or 2 carbon atoms, halogen, nitro,

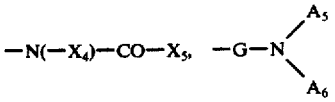

or —$COOX_6$, $X_4$ represents hydrogen, alkyl with 1 or 2 carbon atoms or phenyl, $X_5$ represents alkyl with 1 or 2 carbon atoms, $X_6$ represents alkyl with 1 or 2 carbon atoms or phenyl, $Z_{10}$ and $Z_{11}$ each represent hydrogen, alkyl with 1 or 2 carbon atoms, alkoxy with 1 or 2 carbon atoms or halogen, G represents —CO— or —$SO_2$—; $A_5$, $A_6$, $A_5'$ and $A_6'$ each represent alkyl with 1 or 2 carbon atoms or phenyl or $A_5$ and $A_6$ and $A_5'$ and $A_6'$ respectively together with the nitrogen atoms to which they are bound form a heterocyclic ring system with one or two rings consisting of carbon, nitrogen and at most one oxygen as ring members, each ring containing 5 to 7 ring members and the ring system containing at most 10 ring members.

Very suitable colour formers are triazenes of the formula X:

(X)

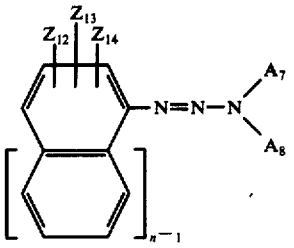

in which $Z_{12}$ represents hydrogen, methyl, methoxy, chlorine, nitro,

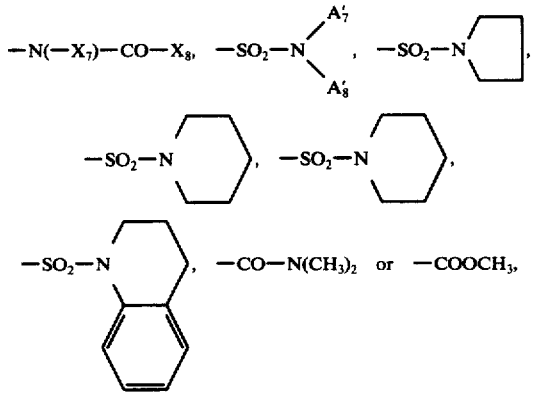

$Z_{13}$ is hydrogen, methyl, methoxy or chlorine
$Z_{14}$ is hydrogen or methoxy
$A_7'$ is methyl, ethyl or phenyl
$A_8'$ is methyl, ethyl or hydrogen
$A_7$ is methyl, ethyl or phenyl
$A_8$ is methyl or ethyl or $A_7$ and $A_8$ together with the nitrogen atom to which they are bound represent

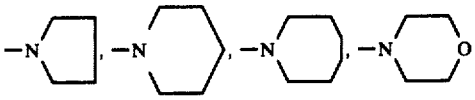

$X_7$ is hydrogen or methyl, $X_8$ is methyl or phenyl and $n$ is 1 or 2.

These colour formers as such either are well known or may be prepared by conventional methods known in the art. A general method e.g. can be described thus:

The primary aromatic amine is dissolved in hydrochloric acid and water, then the solution is cooled to 0° C with ice. Sodium nitrite is added beneath the surface at such a rate that a slight excess of nitrous acid is always present. When the diazotisation is complete the reaction mixture is added to a solution or suspension of the secondary amine and sodium hydrogen carbonate in water at 10° C. The reaction mixture is stirred and allowed to reach room temperature. Stirring is continued until no diazonium compound can be detected. The product is out of solution and is filtered off or extracted into an organic solvent, washed with water and dried in vacuo at temperature below 50° C.

These colour formers as such are colourless and can form coloured images when brought into contact with a typical azoic coupling substance and the organic acid.

Suitable colour formers of the formula II, e.g. are:

Table III

| | Symbols in formula (II) | | | | | | |
|---|---|---|---|---|---|---|---|
| No. | Z1 | Z2 | Z3 | n | position —N=N | A1 | $A_2$ |
| 6.1 | 3-$SO_2N(CH_3)2$ | 4-CH3 | H | I | I | —CH3 | —CH3 |
| 6.2 | | | | | | —$C_2H5$ | —$C_2H5$ |
| 6.3 | | | | | | 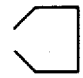 | |
| 6.4 | | | | | | 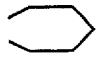 | |
| 6.5 | | | | | | 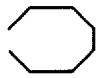 | |
| 6.6 | | | | | | 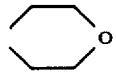 | |
| 6.7 | 3-$SO_2N(C_2H_5)2$ | | | | | —CH3 | —CH3 |
| 6.8 | | | | | | 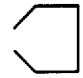 | |
| 6.9 | | | | | | 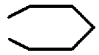 | |
| 6.10 | | | | | | 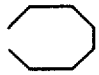 | |
| 6.11 | 3-$SO_2$— 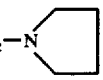 | | | | | —CH3 | —CH3 |
| 6.12 | | | | | | 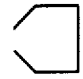 | |

Table III-continued

| No. | Z1 | Z2 | Z3 | n | position —N=N | A1 | $A_2$ |
|---|---|---|---|---|---|---|---|
| | | Symbols in formula (II) | | | | | |
| 6.13 | | | | | | | |
| 6.14 | | | | | | | |
| 6.15 | | | | | | | |
| 6.16 | 3-$SO_2$—N | | | | | —CH3 | —CH3 |
| 6.17 | | | | | | | |
| 6.18 | | | | | | | |
| 6.19 | | | | | | | |
| 6.20 | | | | | | | |
| 6.21 | 3-$SO_2$—N | 4-CH3 | H | I | I | —CH3 | —CH3 |
| 6.22 | | | | | | | |
| 6.23 | | | | | | | |
| 6.24 | | | | | | | |
| 6.25 | | | | | | | |
| 6.26 | 3-$SO_2$—NH—$C_6H_5$ | | | | | | |
| 6.27 | 3-$SO_2$—N($CH_3$)($C_6H_5$) | | | | | —CH3 | —CH3 |
| 6.28 | | | | | | | |
| 6.29 | | | | | | | |
| 6.30 | | | | | | | |
| 6.31 | | | | | | | |
| 6.32 | 3-$SO_2$—N($C_2H_5$)($C_6H_5$) | | | | | —CH3 | —CH3 |
| 6.33 | 3-$SO_2$—N | | | | | | |
| 6.34 | | | | | | —$C_2H_5$ | —$C_2H_5$ |

Table III-continued

| No. | Z1 | Z2 | Z3 | n | position —N=N | A1 | $A_2$ |
|---|---|---|---|---|---|---|---|
| | | Symbols in formula (II) | | | | | |
| 6.35 | | | | | | | 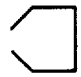 |
| 6.36 | | | | | | | 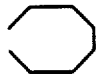 |
| 6.37 | | | | | | | 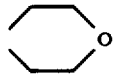 |
| 6.38 | 4-N(CO—$CH_3$)($CH_3$) | H | | | | | 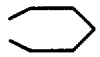 |
| 6.39 | 4-NH—CO—$C_6H5$ | 2-OCH3 | 5-OCH3 | | | | |
| 6.40 | 4-CO—N($CH_3$)($CH_3$) | H | H | | | | |
| 6.41 | 2-COOCH3 | | | | | | |
| 6.42 | 4-NO2 | H | H | I | I | | 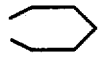 |
| 6.43 | 4-Cl | 2-CH3 | | | | | |
| 6.44 | 5-OCH3 | 2-OCH3 | | | | | |
| 6.45 | 4-OCH3 | | | | | | |
| 6.46 | | | 5-Cl | | | | |
| 6.47 | 4-$SO_2N(C_2H_5)$ | H | H | | | | |
| 6.48 | 4-$SO_2$—N  | | | | | | |
| 6.49 | 2-$SO_2$N($C_2H_5$)($C_6H_5$) | | | | | | |
| 6.50 | 3-$SO_2$—N  | | | | | | |
| 6.51 | 5-$SO_2N(C_2H_5)2$ | 2-OCH3 | | | | | |
| 6.52 | | | | | | | 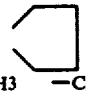 |
| 6.53 | 4-Cl | 2-CH3 | | | | —CH3 | —$C_6H5$ |
| 6.54 | 4-OCH3 | 2-OCH3 | | | | | |
| 6.55 | 5-OCH3 | | | | | | |
| 6.56 | 5-Cl | 2-Cl | | | | | |
| 6.57 | | 2-CH3 | | | | | |
| 6.58 | 4-$SO_2N(C_2H_5)2$ | H | | | | —CH3 | —CH3 |
| 6.59 | 4-$SO_2$—N  | | | | | | |
| 6.60 | 5-$SO_2$—$N(C_2H_5)2$ | | | | | —$C_2H5$ | —$C_2H5$ |
| 6.61 | —H | | | 2 | | | 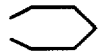 |
| 6.62 | 5-$SO_2$—$N(C_2H_5)2$ | | | | | | |
| 6.63 | 4-$SO_2$—N  | | | | | | |
| 6.64 | 6-$SO_2$—N  | | | | | | |
| 6.65 | 5-$SO_2$—$N(C_2H_5)2$ | | | | | | |
| 6.66 | 5-$SO_2$—$N(C_2H_5)2$ | | | | | —CH3 | —$CH_3$ |

When a triazene compound of formula II is used as colour former the azo coupling component preferably is a naphthalene, benzene, pyrazolone or quinoline or more particularly a naphthol or a naphthylamine.

Suitable azo coupling components are those of the formula:

-continued

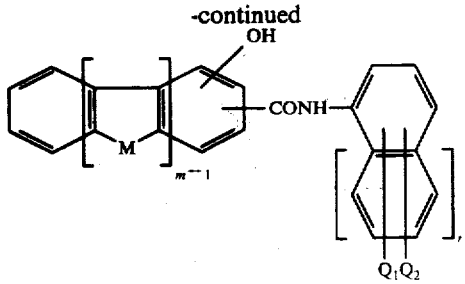

(XI)

are of special interest, in which M is —NH—, —S— or —O—, $Q_1$ and $Q_2$ each represent hydrogen, nitro, halogen, alkyl with 1 to 4 carbon atoms or alkoxy with 1 to 4 carbon atoms, *m* and *r* are each 1 or 2.

Naphthylamines which are very valuable correspond to the formula (XII)

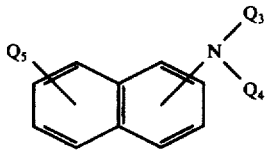

in which $Q_3$ and $Q_4$ each represent hydrogen, alkyl with 1 to 4 carbon atoms, benzyl or phenyl or where $Q_3$, $Q_4$ and the nitrogen atom to which they are bound together form a heterocyclic ring system with one or two rings consisting of carbon, nitrogen and at most one oxygen as ring members, each ring containing 5 to 7 ring members and the ring system containing at most 10 ring members and $Q_5$ is hydrogen or a sulfonic acid group.

All the azo couplers suitable for use in the present invention are of the well known couplers used for making azo dyestuffs and they thus are known as such and are prepared by well known methods.

The following compounds of formula XI e.g. are very suitable as coupling components:

Table IV

| | symbols in formula (XI) | | | | | | |
|---|---|---|---|---|---|---|---|
| No. | position of —OH | position of —CONH— | m | M | r | Q1 | $Q_2$ |
| 8.1 | 2 | 3 | 1 | — | 1 | H | H |
| 8.2 | 2 | 3 | 1 | — | 1 | 4-Cl | H |
| 8.3 | 2 | 3 | 1 | — | 1 | 4-Cl | 2-CH3 |
| 8.4 | 2 | 3 | 1 | — | 1 | H | 2-OCH3 |
| 8.5 | 2 | 3 | 1 | — | 1 | H | 2-CH3 |
| 8.6 | 2 | 3 | 1 | — | 1 | 3-NO2 | H |
| 8.7 | 2 | 3 | 1 | — | 1 | 5-OCH3 | 2-OCH3 |
| 8.8 | 2 | 3 | 1 | — | 1 | 4-OCH3 | H |
| 8.9 | 2 | 3 | 1 | — | 1 | 4-OCH3 | 3-Cl |
| 8.10 | 2 | 3 | 1 | — | 1 | 5-Cl | 2-CH3 |
| 8.11 | 2 | 3 | 1 | — | 1 | 4-CH3 | H |
| 8.12 | 3 | 4 | 2 | NH | 1 | 4-Cl | H |
| 8.13 | 2 | 3 | 2 | O | 1 | 5-OCH3 | 2-OCH3 |
| 8.14 | 2 | 3 | 1 | — | 2 | H | H |

Naphthylamines of formula XII e.g. are:

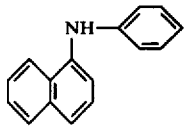

(9.1)

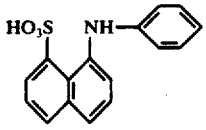

(9.2)

Further suitable azo couplers correspond to these formulae:

-continued

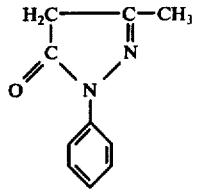

(10.1)

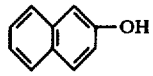

(10.2)

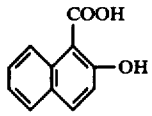

(10.3)

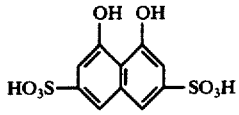

(10.4)

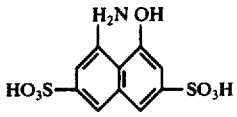

(10.5)

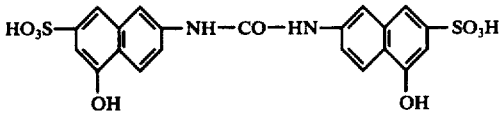

(10.6)

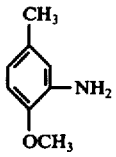

(10.7)

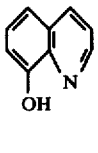

(10.8)

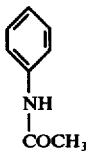

(10.9)

With these colour formers a large variety of colours may be produced ranging from crange to violet. Mixtures of such colour formers are suitable to give neutral shades such as grey. A special advantage of the triazenes is the light fastness of the colours they produce.

The paper treated with a dispersion according to the present invention may be printed using an ink as described and claimed in British patent application No. 18199/74 and, providing the ink used contains a colour former with a different colour change to that already on the paper or produces a different colour change by virtue of the ink containing a differently coloured dye or pigment, two colour changes will be observed when the paper is treated with an acid.

The invention will be illustrated by the following Examples, in which parts and percentages are by weight.

EXAMPLE 1

A sample of 35gm$^{-2}$ paper was coated both sides with printing ink 1 using a draw-down technique. The coated sheet was dried at 80° C and planchettes were formed from this using a punch. These were incorporated into paper produced on a laboratory sheet machine from wood pulp stock internally sized with Aquapel 360 and containing 6% by weight of Pergopak M filler. The final sheet produced was 100gm$^{-2}$.

Application of the activator to the sheet produced the following reactions:

Base sheet — no reaction
Planchettes — orange/yellow → red.

A sample of the finished sheet was then coated with dispersion 2 using size press techniques. The paper was then dried at 80° C. Application of the activator to the sheet produced the following reactions:

Base sheet — no reaction.
Base sheet with dispersion 2 — green → pink/red.
Planchettes — orange → red.

Using a pen some printing ink 4 was applied to the finished sheet. Application of the activator to the sample produced the following reactions:

Base sheet — no reaction.
Base sheet with dispersion 2; green → pink/red.
Planchettes — orange → red.
Printing ink 4 on surface — green → blue/black.

EXAMPLE 2

Example 1 was repeated using planchettes formed from 40gm$-^2$ paper and printing ink 2. Also incorporated into the sheet were normal yellow planchettes of 31gm$-^2$. The final sheet weight was 120gm$-^2$. Activation produced the following results:

Base sheet — no reaction.
Planchettes — orange → blue.
Normal yellow planchettes — no reaction.

A sample of the finished sheet was then coated with dispersion 2 as in Example 1. Activation produced the following results:

Base sheet — no reaction.
Base sheet with dispersion 2 — green → pink/red.
Planchettes — orange → blue.
Normal yellow planchettes — no reaction.

Using a pen some printing ink 1 was applied to the finished sheet. Activation produced the following results:

Base sheet — no reaction.
Base sheet with dispersion 2 — green → pink/red.
Planchettes — orange → blue.
Normal yellow planchettes — no reaction.
Printing ink 1 on surface — orange → red.

EXAMPLE 3

Example 1 was repeated using planchettes formed from 22gm$-^2$ paper and printing ink 3. The final sheet weight was 60gm$-^2$. Activation produced the following results:

Base sheet — no reaction.
Planchettes — orange → red.

A sample of the finished sheet was then coated with dispersion 1 as in Example 1. Activation produced the following results:

Base sheet — no reaction.
Base sheet with dispersion 1 — yellow → pink/red.
Planchettes — orange → red.

Using a pen some printing ink 2 was applied to the finished sheet. Activation produced the following results:

Base sheet — no reaction.
Base sheet with dispersion 1 — yellow → pink/red.
Planchettes — orange → red.
Printing ink 2 on surface — orange → blue.

EXAMPLE 4

Example 1 was repeated using planchettes formed from 26gm$-^2$ paper and printing ink 4. The final sheet weight was 140gm$-^2$. Activation produced the following results:

Base sheet — no reaction.
Planchettes — green → blue/black.

A sample of the finished sheet was then coated with dispersion 1 as in Example 1. Activation produced the following results:

Base sheet — no reaction.
Base sheet with dispersion 1 — yellow → pink/red.
Planchettes — green → blue/black.

Using a pen some printing ink 5 was applied to the finished sheet. Activation produced the following results:

Base sheet — no reaction.
Base sheet with dispersion 1 — yellow → pink/red.
Planchettes — green → blue/black.
Printing ink 5 on surface — orange → blue/black.

EXAMPLE 5

Example 1 was repeated using planchettes formed from 50gm$-^2$ paper and printing ink 5. The final sheet weight was 100gm$-^2$. Activation produced the following results:

Base sheet — no reaction.
Planchettes — orange → blue/black.

A sample of the finished sheet was then coated with dispersion 2 as in Example 1. Activation produced the following results:

Base sheet — no reaction.
Base sheet with dispersion 2 — green → pink/red.
Planchettes — orange → blue/black.

Using a pen some printing ink 4 was applied to the finished sheet. Activation produced the following results:

Base sheet — no reaction.
Base sheet with dispersion 2 — green → pink/red.
Planchettes — orange → blue/black.
Printing ink 4 on surface — green → blue/black.

EXAMPLE 6

A sample of 26gm$-^2$ paper was coated both sides with dispersion 1 using a size -press technique. The coated sheet was dried at 80° C and planchettes were formed from this using a punch. These were incorporated into paper produced on a laboratory sheet machine from wood pulp stock internally sized with Aquapel 360 and containing 6% by weight of Pergopak M filler. The final sheet produced also contained normal blue 26gm$-^2$ planchettes and was 80gm$-^2$ in weight.

Application of the activator to the sheet produced the following reactions:

Base sheet — no reaction.
Planchettes — yellow→pink/red.
Normal planchettes — no reaction.

A sample of the finished sheet was then coated with dispersion 2 as in Example 1. Activation produced the following reactions:

Base sheet — no reaction.
Base sheet with dispersion 2 — green→pink/red.
Normal planchettes — no reaction.
Planchettes — colour change masked by dispersion reaction.

Using a pen some printing ink 2 was applied to the finished sheet. Activation produced the following results:

Base sheet — no reaction.
Base sheet with dispersion 2 — green→pink/red.
Normal planchettes — no reaction.
Planchettes — colour change masked by dispersion reaction.

Printing ink 2 on surface — orange→blue/black.

EXAMPLE 7

Example 6 was repeated using planchettes formed from 50gm$-^2$ paper and dispersion 2. The final sheet weight was 140gm$-^2$. Activation produced the following results:

Base sheet — no reaction.

Planchettes — green→pink/red.

A sample of the finished sheet was then coated with dispersion 1 as in Example 1. Activation produced the following reactions:

Base sheet — no reaction.

Base sheet with dispersion 1 — yellow→pink/red.

Planchette — yellow/green→pink/red.

Using a pen some printing ink 2 was applied to the finished sheet. Activation produced the following results:

Base sheet — no reaction.

Base sheet with dispersion 1 — yellow→pink/red.

Planchettes — yellow/green→pink/red.

Printing ink 2 on surface — orange→blue.

FORMATION OF DISPERSIONS USED IN EXAMPLES

A 4% w/v solution of FW 420 starch (Starch Products Ltd) was prepared in tap water. To 100 mls of this was added 0;0052g of Belloid TD(ex Ciba-Geigy (UK) Ltd) dissolved in a small quantity of water. The solutions were stirred throughout the preparation. Stirring was continued and 0.50 mls Aronal S 320 D (ex B.A.S.F.) were added. A solution of 0.044g colour-former CP2015 in cellosolve was then added to produce a dispersion. The final volume was adjusted to 100 mls with water to give dispersion 1.

Dispersion 2 was formed by adding 0.05g Paper direct green PD 160 (ex ciba-Geigy) to 50 mls of dispersion 1.

FORMATION OF PRINTING INKS USED IN EXAMPLES

A nitrocellulose base was formed by dissolving 31g DLX 8/13 NC damped with IMS (ex ICI) in 60g industrial methylated spirit and 9g cellosolve. This was diluted to 50% by weight using industrial methylated spirit and cellosolve in the ratio 60:9. The final solution was used as nitrocellulose base to produce the following ink medium:

10g Industrial methylated spirit

5g Acetore 12.25g NC base 0.5g Triethanolamine.

The appropriate colour-formers and/or dyes were dissolved in this ink medium to produce the printing inks as follows:

| Printing ink | Wt of ink medium (g) | Wt of colour-former (g) | Wt of dye (g) |
|---|---|---|---|
| 1 | 5 | 0.05g CP2015 | — |
| 2 | 5 | 0.05g CP2034 | — |
| 3 | 5 | 0.05g Colfo red | 0.05 Soluble Yellow D (ex Geigy) |
| 4 | 5 | 0.05g CP2015 | 0.05g Brilliant Green YNS Crystals (ex ICI) |
| 5 | 5 | 0.05g CP2034 | 0.05g Soluble yellow D (ex Geigy) |

It should be noted that the dye used in planchettes for Examples 3 and 5 tended to bleed into the water during the formation of the sheet. This did not affect the reaction obtained.

I claim:

1. Paper for use in the production of security documents by printing thereon, which paper incorporates planchettes, said planchettes having incorporated therein or applied thereto a substance which is capable of taking part in a color-forming reaction whereby, when a security document produced from said paper is verified by the application of a reagent or reagents, the said substance changes color by the color-forming reaction, and wherein said paper may additionally comprise one or more substances capable of taking part in a color-forming reaction, said substance not being incorporated in said planchettes.

2. Paper according to claim 1 wherein the planchettes are a mixture of planchettes having a first substance which is capable of taking part in a colour-forming reaction incorporated therein or applied thereto and other planchettes having a second substance which is capable of taking part in a different colour-forming reaction whereby when verification of the security document is effected by the application of a reagent or reagents, the said first and second substances change colour by the colour forming reactions.

3. Paper according to claim 2 wherein the second substance comprises at least one colour-former and at least one dye or pigment.

4. Paper according to claim 2 wherein the first substance comprises at least one colour-former and at least one dye or pigment.

5. Paper according to claim 2 wherein the first and second substances comprise or consist of at least one colour-former which is an azo compound having the general formula I (I)

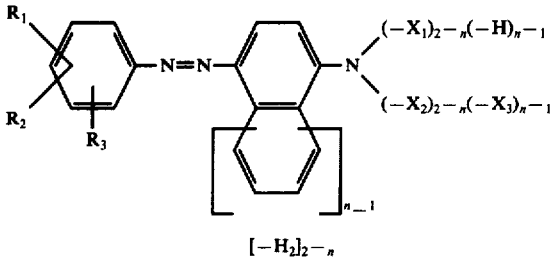

in which $R_1$, $R_2$ and $R_3$ each represents hydrogen, halogen, alkyl, alkoxy, aryloxy, alkoxycarbonyl, dialkylaminocarbonyl, acylamino, acyl(alkyl)amino,

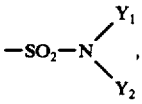

in which $Y_1$ and $Y_2$ each represents alkyl or aryl, or in which $Y_1$ and $Y_2$ together represent an alkylene group; $X_1$ is hydrogen or an alkyl group, $X_2$ is an alkyl, cyanoalkyl or arylmethylene group or $X_1$ and $X_2$ together represent an alkylene group, $X_3$ is an alkyl or aryl group and $n$ is 1 or 2, preferably 1, or which is a compound having the general formula II:

(II)

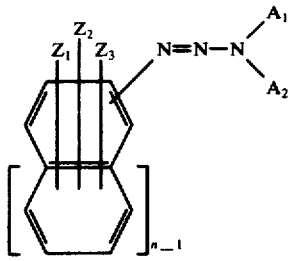

in which $Z_1$, $Z_2$ and $Z_3$ each represents hydrogen, alkyl, substituted alkyl, alkoxy, halogen, nitro, acylamino, aminoacyl or alkoxycarbonyl, $A_1$ and $A_2$ each represents alkyl or phenyl or $A_1$ and $A_2$ together with the nitrogen atom to which they are bound form a heterocyclic ring system and $n$ is 1 or 2.

6. Paper according to claim 5 wherein the reagent is an organic acid selected from the group consisting of maleic acid, oxalic acid, malonic acid, succinic acid, glutaric acid, adipic acid, tricarballylic acid, diglycollic acid, lactic acid, malic acid, tartaric acid, citric acid, pyrophosphonic acid, benzene sulphonic acid, naphthalene-2-sulphonic acid, 1-phenol-4-sulphonic acid, polymaleic acid, co- and ter-polymers of maleic acid with ethyl acrylate and vinyl acetate, hydroxyethane disphosphonic acid and methylamino-N-N-di-methylene phosphonic acid providing that when the colour-former is a compound having the formula II there is also present an azo complex.

7. Paper according to claim 1 wherein the first substance comprises at least one colour-former and at least one dye or pigment.

8. Paper according to claim 1 which paper is in the form of a paper strip adhered to a continuous sheet of plastics material.

9. Paper according to claim 1 wherein the substance weight of the planchettes is from 15 to 50 grammes per square meter.

10. Paper according to claim 1 which paper additionally comprises conventional planchettes.

11. Paper according to claim 1 wherein the first substance comprises or consists of at least one colour-former which is an azo compound having the general formula I (I)

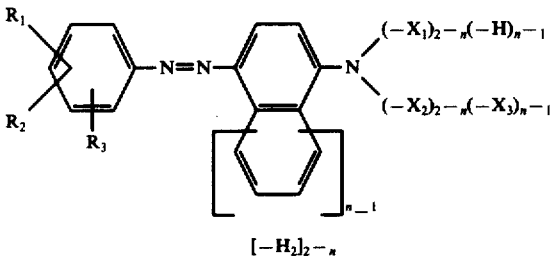

in which $R_1$, $R_2$ and $R_3$ each represents hydrogen, halogen, alkyl, alkoxy, aryloxy, alkoxycarbonyl, dialkylaminocarbonyl, acylamino, acyl(alkyl)amino,

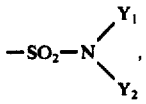

in which $Y_1$ and $Y_2$ each represents alkyl or aryl, or in which $Y_1$ and $Y_2$ together represent an alkylene group; $X_1$ is hydrogen or an alkyl group, $X_2$ is an alkyl, cyanoalkyl or arylmethylene group or $X_1$ and $X_2$ together represent an alkylene group, $X_3$ is an alkyl or aryl group and $n$ is 1 or 2, preferably 1, or which is a compound having the general formula II:

(II)

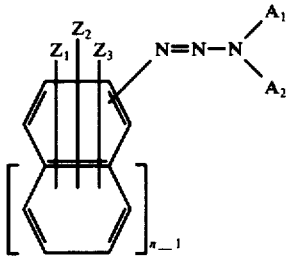

in which $Z_1$, $Z_2$ and $Z_3$ each represents hydrogen, alkyl, substituted alkyl, alkoxy, halogen, nitro, acylamino, aminoacyl or alkoxycarbonyl, $A_1$ and $A_2$ each represents alkyl or phenyl or $A_1$ and $A_2$ together with the nitrogen atom to which they are bound form a heterocyclic ring system and $n$ is 1 or 2.

12. Paper according to claim 11 wherein the reagent is an organic acid selected from the group consisting of maleic acid, oxalic acid, malonic acid, succinic acid, glutaric acid, adipic acid, tricarballylic acid, diglycollic acid, lactic acid, malic acid, tartaric acid, citric acid, pyrophosphonic acid, benzene sulphonic acid, naphthalene-2-sulphonic acid, 1-phenol-4-sulphonic acid, polymaleic acid, co- and ter-polymers of maleic acid with ethyl acrylate and vinyl acetate, hydroxyethane diphosphonic acid and methylamino-N-N-di-methylene phosphonic acid providing that when the colour-former is a compound having the formula II there is also present an azo complex.

13. A security document which comprises printed paper incorporates planchettes, said planchettes having incorporated therein or applied thereto a substance which is capable of taking part in a color-forming reaction whereby, when a security document produced from said paper is verified by the application of a reagent or reagents, the said substance changes color by the color-forming reaction, and wherein said paper may additionally comprise one or more substances capable of taking part in a color-forming reaction, said substance not being incorporated in said planchettes.

14. A security document according to claim 13 wherein the printed material on the paper includes one or more substances which are capable of taking part in a colour-forming reaction.

15. A security document which comprises printed paper which paper incorporates planchettes wherein the planchettes are a mixture of planchettes having a first substance which is capable of taking part in a color-forming reaction incorporated therein or applied thereto and other planchettes having a second substance which is capable of taking part in a different color-forming reaction whereby when verification of the security document is effected by the application of a reagent or reagents, the said first and second substances change color by the color-forming reactions, and wherein said paper may additionally comprise one or more substances capable of taking part in a color-forming reaction, said substance not being incorporated in said planchettes.

* * * * *